US011124013B2

(12) United States Patent
Rolion et al.

(10) Patent No.: US 11,124,013 B2
(45) Date of Patent: Sep. 21, 2021

(54) WRITING INSTRUMENT COMPRISING TWO CONCENTRIC WRITING TIPS

(71) Applicant: SOCIETE BIC, Clichy (FR)

(72) Inventors: Franck Rolion, Asnières-sur-Oise (FR); Arnaud Bez, Garches (FR); Samuel Malinverni, Paris (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 16/646,291

(22) PCT Filed: Sep. 17, 2018

(86) PCT No.: PCT/FR2018/052265

§ 371 (c)(1),
(2) Date: Mar. 11, 2020

(87) PCT Pub. No.: WO2019/058048

PCT Pub. Date: Mar. 28, 2019

(65) Prior Publication Data

US 2020/0282762 A1 Sep. 10, 2020

(30) Foreign Application Priority Data

Sep. 19, 2017 (FR) ..... 1758663

(51) Int. Cl.
*B43K 27/08* (2006.01)
*B43K 1/06* (2006.01)
(Continued)

(52) U.S. Cl.
CPC ..... *B43K 27/08* (2013.01); *B43K 1/06* (2013.01); *B43K 8/028* (2013.01); *B43K 8/24* (2013.01);
(Continued)

(58) Field of Classification Search
CPC ..... B43K 27/08; B43K 27/12; B43K 1/06; B43K 8/028; B43K 8/02; B43K 8/24;
(Continued)

(56) References Cited

U.S. PATENT DOCUMENTS 6,135,660 A * 10/2000 Stevens ..... B43K 5/17 401/103
7,334,954 B1 * 2/2008 Rentz ..... B43K 8/003 401/107
(Continued)

FOREIGN PATENT DOCUMENTS

CN 101823386 A 9/2010
DE 202008014861 U1 2/2009
(Continued)

OTHER PUBLICATIONS

International Search Report and Written Opinion issued in International Application PCT/FR2018/052265, dated Jan. 15, 2019 (9 pages).
(Continued)

*Primary Examiner* — David J Walczak
(74) *Attorney, Agent, or Firm* — Bookoff McAndrews, PLLC

(57) ABSTRACT

A writing instrument comprising a housing extending in a longitudinal direction and having a radial direction, and first and second concentric writing tips, the second writing tip arranged around the first writing tip, each writing tip received in the housing and able to assume an operating configuration, the housing comprising, at a longitudinal end, a deformable nose at least in the radial direction, the deformable nose comprising at least one slit extending in the longitudinal direction, the deformable nose not being deformed when only the first writing tip is in an operating configuration and the deformable nose being deformed when the second writing tip is in an operating configuration, the
(Continued)

deformable nose comprising an exit opening of the first and second writing tips, the diameter of the exit opening being greater than the diameter of the first writing tip and less than that of the second writing tip.

13 Claims, 4 Drawing Sheets

(51) Int. Cl.

| | |
|---|---|
| ***B43K 8/02*** | (2006.01) |
| ***B43K 8/24*** | (2006.01) |
| ***B43K 24/14*** | (2006.01) |
| ***B43K 24/10*** | (2006.01) |

(52) U.S. Cl.
CPC ..... *B43K 24/146* (2013.01); *B43K 24/10* (2013.01); *B43K 24/14* (2013.01)

(58) Field of Classification Search
CPC ..... B43K 24/146; B43K 24/10; B43K 24/14; B43K 27/00; B43K 27/006; B43K 27/02
USPC ..... 401/107–108, 29–34
See application file for complete search history.

(56) References Cited

U.S. PATENT DOCUMENTS

| | | | | |
|---|---|---|---|---|
| 2004/0161282 | A1* | 8/2004 | Bolton | B43K 17/005 401/35 |
| 2005/0042015 | A1* | 2/2005 | Patel | B43K 5/1845 401/37 |
| 2007/0274761 | A1* | 11/2007 | Shim | B43K 8/028 401/31 |

FOREIGN PATENT DOCUMENTS

| | | | |
|---|---|---|---|
| EP | 2074903 | A1 | 7/2009 |
| GN | 1618629 | A | 5/2005 |
| GN | 101102908 | A | 1/2008 |
| GN | 100522654 | C | 8/2009 |
| WO | 2005047016 | A2 | 5/2005 |

OTHER PUBLICATIONS

Office Action issued in Chinese Patent Application No. 201880055334.5, dated Feb. 19, 2021 (5 pages).
Search Report issued in Chinese Patent Application No. 201880055334.5, dated Feb. 5, 2021 (1 page).

* cited by examiner

WRITING INSTRUMENT COMPRISING TWO CONCENTRIC WRITING TIPS

CROSS REFERENCE TO RELATED APPLICATION(S)

This application is a National Stage Application of International Application No. PCT/FR2018/052265, filed on Sep. 17, 2018, now published as WO2019/058048 and which claims priority to French Application No. FR1758663, filed on Sep. 19, 2017.

BACKGROUND

The present disclosure relates to a writing instrument comprising two concentric writing tips, the second writing tip being arranged around the first writing tip.

The two tips being concentric in relation to each other, the writing instrument comprises a housing having at one longitudinal end of the housing an opening allowing the writing tips, especially the second writing tip, to assume an operating configuration. The opening is sufficiently large to let the second writing tip through.

However, such an opening is generally large compared to the opening of a writing instrument that only has one writing tip. Consequently, when the second writing tip is not in an operating configuration, in other words when the second writing tip is retracted in the housing of the writing instrument, the opening may allow the entry of foreign bodies into the housing of the writing instrument or the accelerated evaporation of certain substances that go into the composition of inks, which is not desirable.

In addition, when only the first writing tip is in an operating configuration, in other words when the first writing tip protrudes from the housing and the second writing tip is retracted in the housing, the opening is relatively large in relation to the first writing tip, a relatively large amount of clearance being present between the first writing tip and the part of the housing forming the opening, which produces an unusual visual effect for the user. This unusual visual effect may bother users or they may find that this writing instrument is visually unpleasant to use or not very ergonomic, especially when using the first writing tip.

SUMMARY

The present disclosure aims to remedy at least some of these disadvantages.

To this end, the present disclosure relates to a writing instrument comprising a housing extending in a longitudinal direction and having a radial direction, the writing instrument comprising a first concentric writing tip and a second concentric writing tip, the second writing tip being arranged around the first writing tip, each writing tip being accommodated in the housing and being able to assume an operating configuration in which the writing tip protrudes from the housing, the housing comprising at a longitudinal end a deformable nose at least in the radial direction, the deformable nose comprising at least a slit extending in the longitudinal direction, the deformable nose not being deformed when only the first writing tip is in an operating configuration and the deformable nose being deformed when the second writing tip is in an operating configuration and the deformable nose comprising an exit opening of the first and second writing tips, the diameter of the exit opening being greater than the diameter of the first writing tip and less than the diameter of the second writing tip.

By means of the presence of the deformable nose which is deformed only when the first writing tip is in an operating configuration and which is deformed when the second writing tip is in an operating configuration, the opening by which the first writing tip protrudes in the operating configuration of the first writing tip has a diameter in the radial direction that is less than the diameter of the second writing tip.

The opening having a diameter smaller than the diameter of the second writing tip, it is much more difficult for foreign bodies to enter into the housing, even when the second writing tip is retracted into the housing of the writing instrument. It is understood that the diameter of the opening is measured when the deformable nose is in a non-deformed configuration.

In addition, when using the first writing tip, the clearance between the first writing tip and the deformable nose is decreased in relation to a writing instrument comprising two concentric writing tips and a non-deformable nose, such that the appearance to a user is essentially equivalent to the appearance of a writing instrument comprising only one writing tip and/or multiple non-concentric writing tips.

When the second writing tip is in an operating configuration, the deformable nose deforms by means of the presence of the slit, extending in the longitudinal direction, that is present in the deformable nose.

In certain embodiments, the first writing tip is fixed.

The first writing tip protrudes permanently from the housing and only the second writing tip is moveable between the operating configuration and a retracted configuration. Therefore, the writing instrument comprises only one mechanism for the advancement and extension of each writing tip.

In certain embodiments, the second writing tip is of a porous material, for example felt or a porous sintered material.

Thus, the second writing tip is better protected against foreign bodies, such as dust for example, and the second writing tip is less susceptible to drying. In fact, the decreased opening of the deformable nose when the second writing tip is not in an operating configuration, in other words when the second writing tip is retracted in the housing of the writing instrument, protects the second writing tip against foreign bodies and decreases the air circulation around the second writing tip.

In certain embodiments, the deformable nose comprises four slits extending in the longitudinal direction.

The presence of four slits may in circumstances facilitate the provision of a deformable nose. The four slits define four tabs in the deformable nose, the four tabs being able to be deformed at least in the radial direction and allowing a more substantial deformation of each tab, while limiting the number of slits borne by the deformable nose.

In certain embodiments, the deformable nose has a Shore hardness greater than or equal to 20 Shore A, specifically greater than or equal to 60 Shore A and less than or equal to 90 Shore A, specifically less than or equal to 80 Shore A.

In certain embodiments, the deformable nose consists of a thermoplastic elastomer, thermoplastic polyurethane or silicone.

In certain embodiments the thermoplastic elastomer is based on SBS, SEBS and/or EPDM.

SBS is a polystyrene-b-polybutadiene-b-polystyrene, SEBS is a polystyrene-b-poly(ethylene-butylene)-b-polystyrene and EPDM is an ethylene-propylene-diene monomer.

In certain embodiments, the writing instrument comprises an assembly ring of the deformable nose with a section of the housing, the deformable nose comprising a receiving portion of the assembly ring.

The deformable nose may be mounted on the assembly ring, which may itself be mounted on a section of the housing in order to form the housing.

In certain embodiments, the deformable nose is overmolded on the assembly ring.

In certain embodiments, the deformable nose is assembled on the assembly ring by radial clamping, screwing or snap-locking.

In certain embodiments, the assembly ring is of a material that is more rigid than the material of the deformable nose.

In certain embodiments, the assembly ring is assembled to one part of the housing by radial clamping, screwing or snap-locking.

In certain embodiments, the deformable nose is overmolded on a section of the housing.

In certain embodiments, the deformable nose is assembled to a part of the housing by radial clamping, screwing or snap-locking.

BRIEF DESCRIPTION OF THE DRAWINGS

Other characteristics of the disclosure will emerge from the following description of the embodiments, provided as non-limiting examples with reference to the attached drawings, in which.

DETAILED DESCRIPTION

Figure 1:
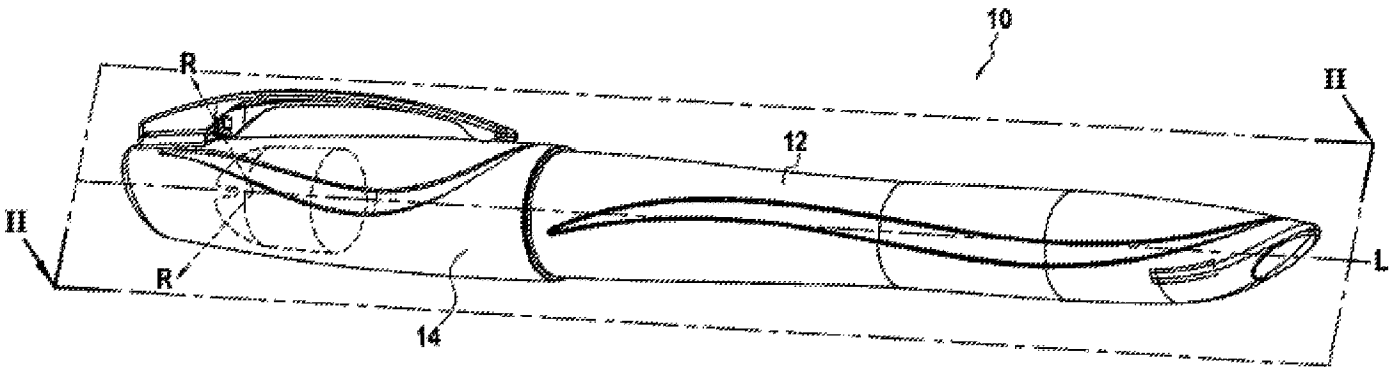
FIG. 1 is a perspective view of a writing instrument according to the disclosure.

FIG. 1 depicts a writing instrument 10 comprising a housing 12 extending in a longitudinal direction L and having a radial direction R and a cap 14 assembled on an end in front of the housing 12.

In the embodiment of FIGS. 1 to 6, the housing 12 comprises a rear housing 12A and a front housing 12B, the rear housing 12A and the front housing 12B being assembled to each other by a snap-lock engagement and being rotatably moveable around the longitudinal direction L in relation to each other.

Hereafter, the terms "front" and "rear" shall be understood as referring to these rear 12A and front 12B housings in longitudinal direction L.

The rear housing 12A comprises at a rear end 12H of the rear housing 12A a rear opening 12G sealed by a plug 12F.

The housing 12 of the writing instrument 10 also comprises a deformable nose 16 and an assembly ring 18 of the deformable nose 16 on a section of the housing 12, in the embodiment of FIG. 1 on a front end 12C of the front housing 12B. The deformable nose 16 comprises at least one slit 16A extending in the longitudinal direction L. In the embodiment of FIGS. 1 to 6, the deformable nose 16 comprises four slits 16A defining four tabs 16B. The four tabs 16B extend in the longitudinal direction L starting from a receiving portion 16C of the deformable nose 16 with the assembly ring 18. The assembly ring 18 comprises a receiving portion 18A of the assembly ring 18 with the deformable nose 16, in particular of the receiving portion 16C of the deformable nose 16 and an assembling portion 18B of the assembly ring 18 on a section of the housing 12, especially the front end 12C of the front housing 12B.

The writing instrument 10 comprises two concentric writing tips, a first writing tip 20 and a second writing tip 22, the second writing tip 22 being arranged around the first writing tip 20. The first and second writing tips 20, 22 are received in the housing 12. Each writing tip, in other words the first writing tip 20 and the second writing tip 22, may assume an operating configuration in which the writing tip protrudes from the housing 12, especially from the deformable nose 16.

Figure 2:
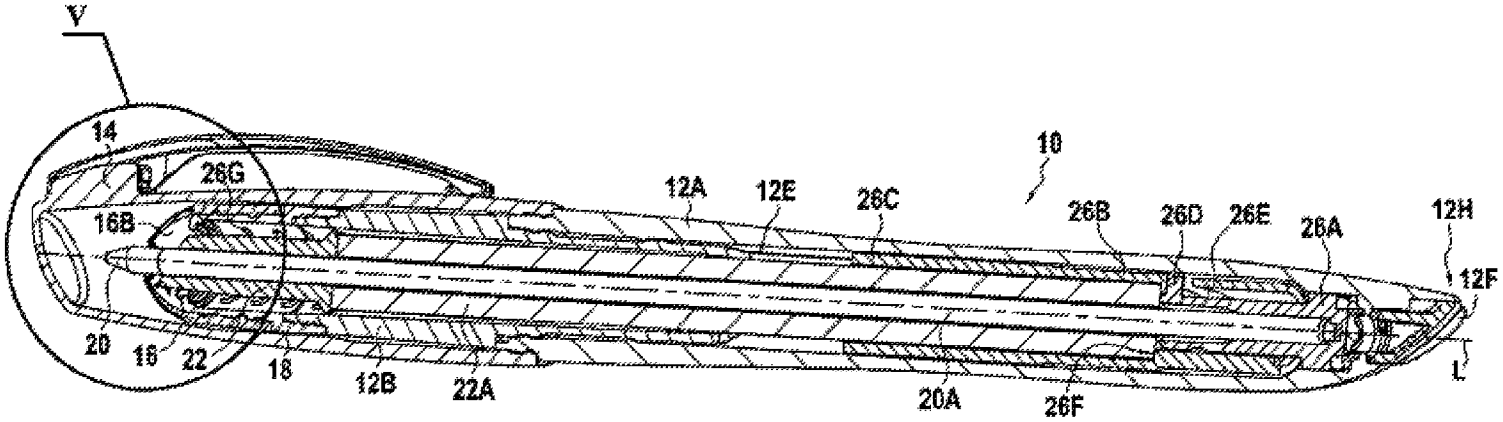
FIG. 2 is a cross-sectional view along the plane II-II of FIG. 1 when the first writing tip is in an operating configuration.
Figure 3:
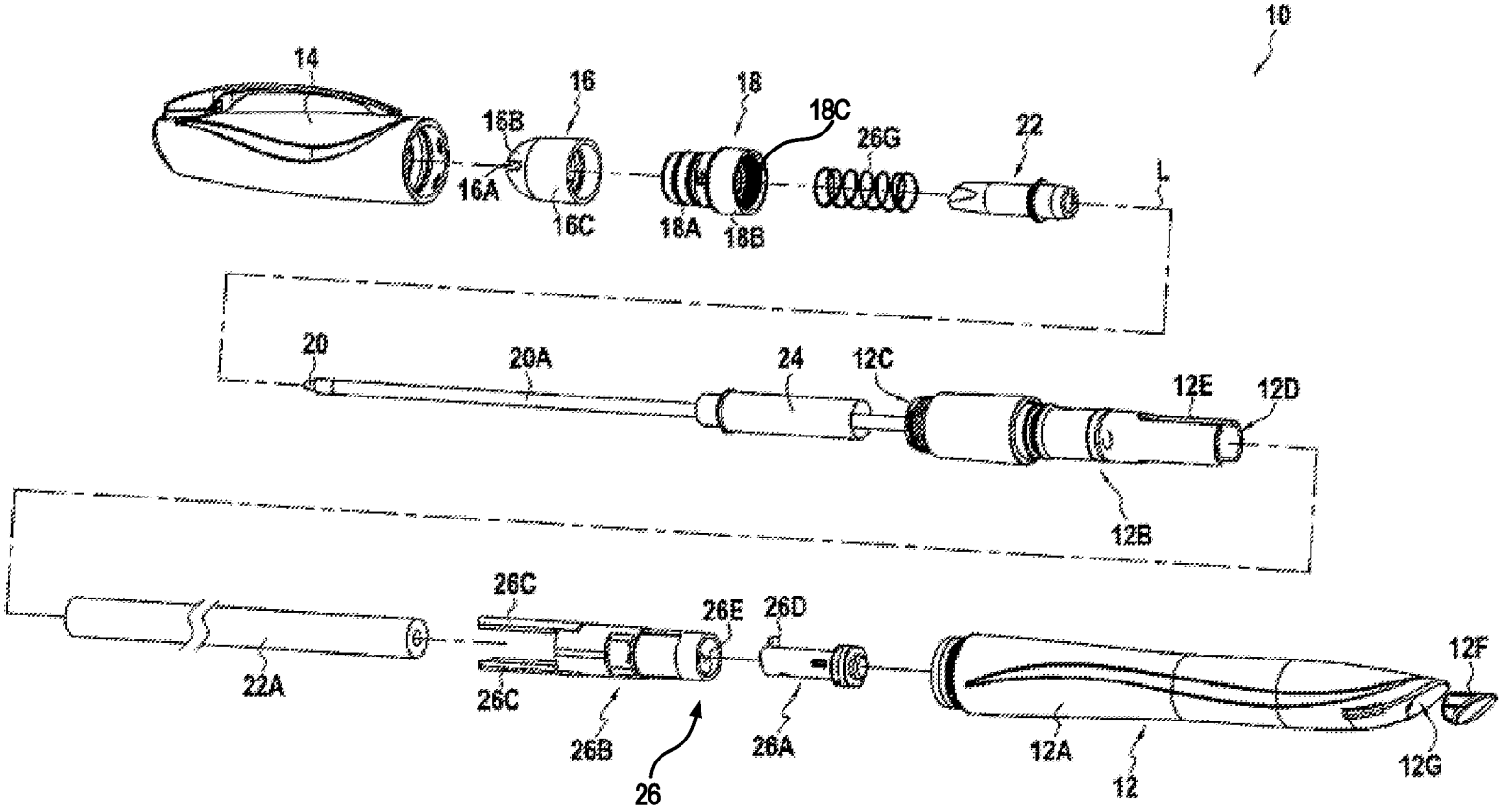
FIGS. 3 and 4 are exploded views of the writing instrument of FIG. 1.
Figure 4:
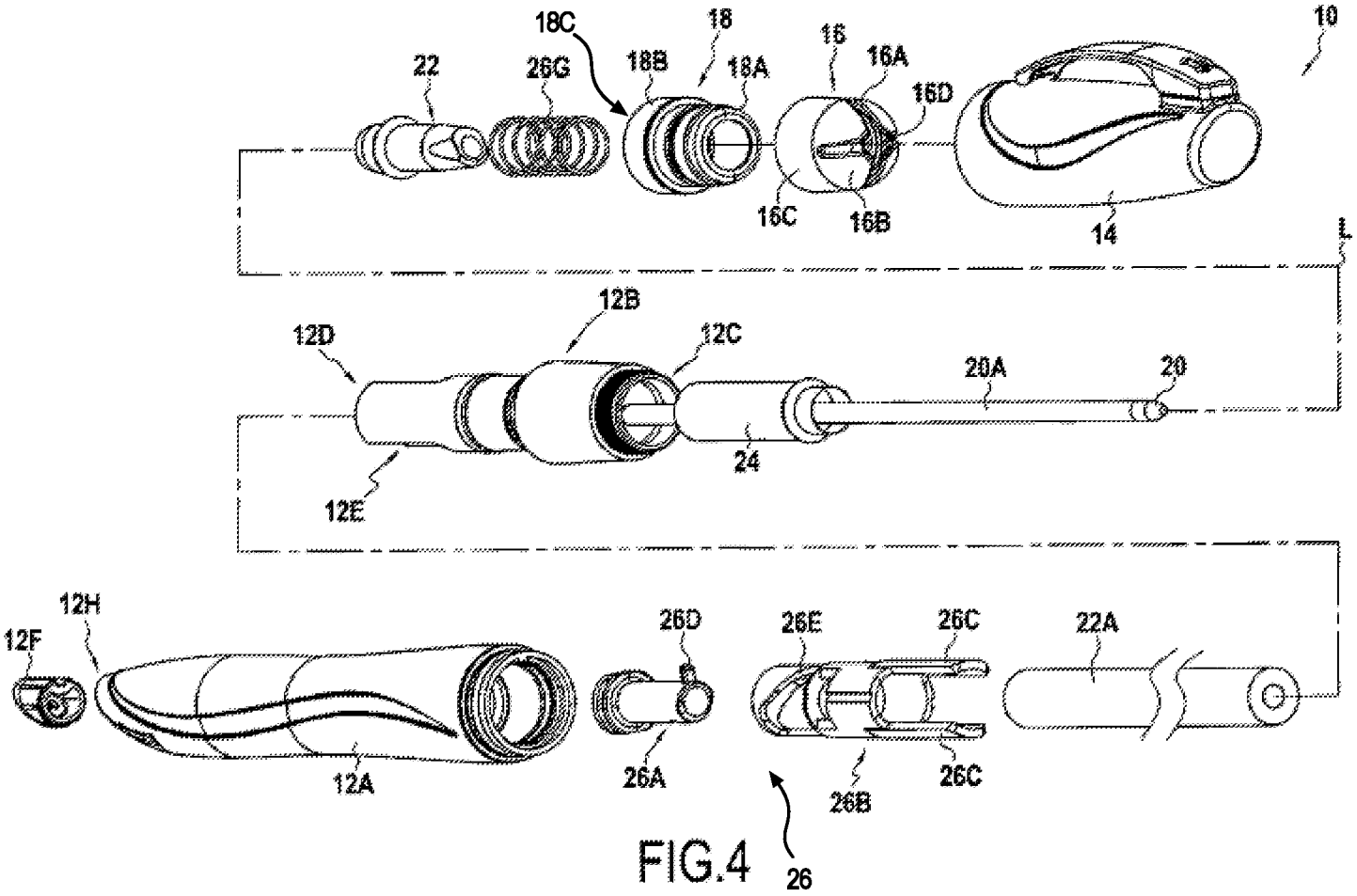
Figure 5:
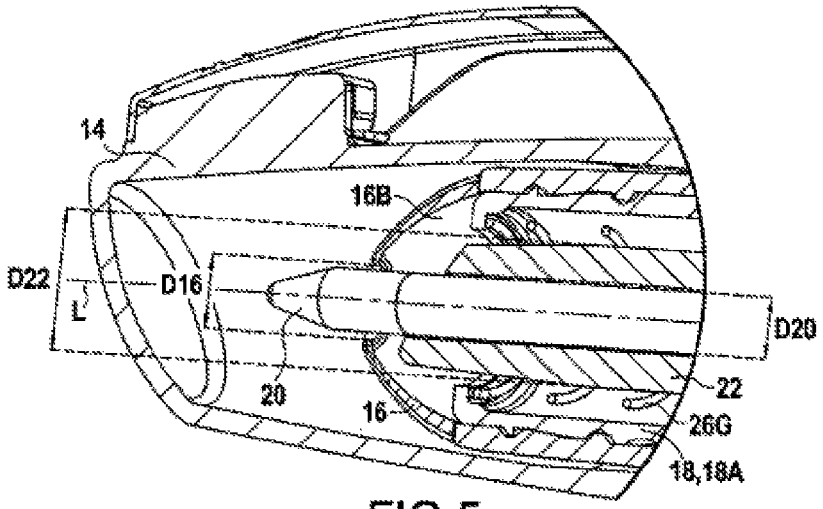
FIGS. 5 and 6 are partial cross-sectional views of the writing instrument according to FIG. 1 according to a cross-sectional plane similar to the cross-sectional plane of FIG. 2 when the first writing tip is in an operating configuration and the second writing tip is in an operating configuration, respectively.
Figure 6:
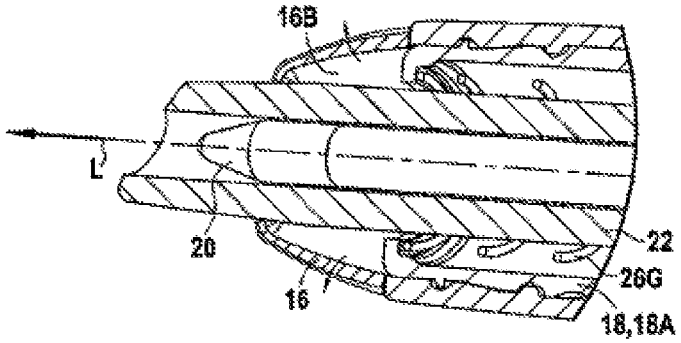

In the embodiment of FIGS. 1 to 6, the first writing tip 20 is a fixed writing tip, for example a ball-type writing tip mounted on an ink reservoir 20A and the second writing tip 22 is a tip that can move between a retracted configuration depicted in FIGS. 2 and 5 and an operating configuration depicted in FIG. 6. For example, the second writing tip 22 may be a highlighter mounted on an ink reservoir 22A. To ensure the support and leak-tightness between the ink reservoir 22A and the second writing tip 22, and to decrease the evaporation surface of the second writing tip 22, the writing instrument 10 comprises a support and sealing sleeve 24 arranged around the second writing tip 22 and the reservoir 22A. As depicted, the second writing tip is arranged around the first writing tip 20 and the reservoir 22A of the second writing tip 22 is arranged around the reservoir 20A of the first writing tip 20.

The deformable nose 16 comprises an exit opening 16D of the first and second writing tips 20, 22, the diameter of the exit opening 16D being greater than the diameter D20 of the first writing tip 20 and less than the diameter D22 of the second writing tip 22.

When the first writing tip 20 is in an operating configuration, in other words when the first writing tip 20 protrudes from the housing 12, especially from the deformable nose 16, and when the second writing tip 22 is in a retracted configuration, the diameter of the exit opening D16 being greater than the diameter D20 of the first writing tip 20, the deformable nose 16 is not deformed.

When the second writing tip 22 is an operating configuration, in other words when the second writing tip protrudes from the housing 12, the diameter of the exit opening D16 being less than the diameter D22 of the second writing tip 22, the deformable nose 16 is deformed. More specifically, the tabs 16B are deformed at least in radial direction R in order to let the second writing tip 22 through.

It shall be noted that the first writing tip 20 being fixed, in an operating configuration of the second writing tip 22, the second writing tip 22 protrudes from the housing 12 more substantially than the first writing tip 20. Therefore, the surface used for writing of the second writing tip 22 may be used on a writing medium without the first writing tip 20 touching this writing medium. Also, even though protruding from the housing 12, when the second writing tip 22 is in an operating configuration, the first writing tip 20 is not in an operating configuration.

The writing instrument 10 also comprises a mechanism 26 allowing the second writing tip 22 to go from the retracted configuration to the operating configuration. The mechanism 26 comprises a rear element 26A and a front element 26B.

The front element 26B comprises two tabs 26C, which engage with windows 12E arranged on a rear end 12D of the front housing 12B of the writing instrument 10 in such a manner that the front element 26B is rotationally fixed in relation to the front housing 12B. The rear element 26A is rotationally and translationally fixed in relation to the rear housing 12A. For example, the rear element 26A is secured by clamping at the rear end 12H of the rear housing 12A. The rear element 26A comprises a pin 26D, which engages with a cam surface 26E of the front element 26B in such a manner that a rotational movement of the front element 26B in relation to the rear element 26A is transformed into a translation movement in longitudinal direction L of the second writing tip 22. In fact, the front element 26B comprises a support surface 26F of the front element 26B on the reservoir 22A of the second writing tip 22.

It is understood that the deformable nose may be made of a relatively flexible material, such as material having a Shore hardness greater than or equal to 22 Shore A, specifically greater than or equal to 60 Shore A and less than or equal to 90 Shore A, specifically less than or equal to 80 Shore. For example, the deformable nose 16 may be made of a thermoplastic elastomer, thermoplastic polyurethane or silicone. Examples of a thermoplastic elastomer include SBS, SEBS and/or EPDM. This is not a complete list.

In examples, the assembly ring 18 is made of a more rigid material than the material of the deformable nose 16.

The material of the assembly ring 18 being more rigid than the material of the deformable nose 16, it is easier to assemble the assembly ring 18 on the front housing 12B than to assemble the deformable nose 16 directly on the front housing 12B. The assembly ring 18 may be assembled on the front housing 12B by radial clamping, screwing or snap-locking.

The deformable nose 16 may also be mounted directly on the front housing 12B.

The deformable nose 16 may be overmolded on a section of the housing or be assembled on a section of the housing by radial clamping, screwing or snap-locking.

Similarly, when the writing instrument 10 comprises an assembly ring 18, the deformable nose 16 may be overmolded on the assembly ring 18 or be assembled on the assembly ring 18 by radial clamping, screwing or snap-locking.

When one wishes to use the second writing tip 22, one rotates the front housing 12B in relation to the rear housing 12A. This rotation of the front housing 12B in relation to the rear housing 12A causes the front element 26B of the mechanism 26 to rotate, allowing the second writing tip 22 to go from the retracted configuration to the operating configuration by the engagement of the tabs 26C of the front element 26B with the windows 12E of the front housing 12B. The rear element 26A of the mechanism 26 that allows the second writing tip 22 to go from the retracted configuration to the operating configuration being fixed in relation to the rear housing 12A, the pin 26D supported by the rear element 26A traverses the cam surface 26E in such a manner that the rotational movement of the front housing 12B in relation to the rear housing 12A is transformed into a translational movement toward the front of the second writing tip 22.

When one wishes to once again use the first writing tip 20, one rotates the front housing 12B in the opposite direction in relation to the rear housing 12A, and by the force of a return spring 26G being supported by the second writing tip 22 and a seat 18C of the assembly ring 18 of the return spring 26G, the second writing tip assumes its retracted configuration in the housing 12. One can thus use the first writing tip 20.

In addition, when the deformable nose 16 is assembled by direct screwing or with the assembly ring 18 on a section of the housing, the front section of the housing, in other words the deformable nose 16 or the unit formed by the deformable nose 16 and the assembly ring 18, may be removed to allow one to change the first writing tip 20 and/or the second writing tip 22 when the reservoir 20A of the first writing tip 20 and/or the reservoir 22A of the second writing tip 22 is empty. One can thereby also change the color of the first and/or the second writing tip 20, 22.

Although the present disclosure was described in reference to a specific sample embodiment, it is obvious that different modifications and changes may be made on these examples without departing from the general scope of the disclosure as defined by the claims. In addition, the individual characteristics of the various embodiments mentioned may be combined into other embodiments. Consequently, the description and the drawings must be considered from an illustrative manner rather than a restrictive one. For example, the first writing tip may not be fixed and could assume an operating configuration and a retracted configuration. The mechanism allowing the second writing tip to go from the retracted configuration to the operating configuration is provided for informational purposes. It is not limiting in any way. The deformable nose is shown having four slits. It could have only one slit.

The invention claimed is:

1. A writing instrument comprising a housing extending in a longitudinal direction and having a radial direction, the writing instrument comprising a first concentric writing tip and a second concentric writing tip, the second writing tip being arranged around the first writing tip, each writing tip being received in the housing and being able to assume an operating configuration in which the writing tip protrudes from the housing, the housing comprising, at a longitudinal end, a deformable nose at least in the radial direction, the deformable nose comprising at least one slit extending in the longitudinal direction, the deformable nose not being deformed when only the first writing tip is in the operating configuration and the deformable nose being deformed when the second writing tip is in the operating configuration and the deformable nose comprising an exit opening of the first and second writing tips, a diameter of the exit opening being greater than a diameter of the first writing tip and less than a diameter of the second writing tip.

2. The writing instrument according to claim 1, wherein the first writing tip is fixed.

3. The writing instrument according to claim 1, wherein the deformable nose comprises four slits extending in the longitudinal direction.

4. The writing instrument according to claim 1, wherein the deformable nose has a Shore hardness greater than or equal to 20 Shore A, and less than or equal to 90 Shore A.

5. The writing instrument according to claim 1, wherein the deformable nose is made of a thermoplastic elastomer, a thermoplastic polyurethane or silicone.

6. The writing instrument according to claim 5, wherein the thermoplastic elastomer is at least one of SBS-, SEBS-, or EPDM-based.

7. The writing instrument according to claim 1, including an assembly ring of the deformable nose with a section of the housing and wherein the deformable nose comprises a receiving portion of the assembly ring.

8. The writing instrument according to claim 7, wherein the assembly ring is made of a material that is more rigid than a material of the deformable nose.

9. The writing instrument according to claim 7, wherein the assembly ring is assembled on a section of the housing by radial clamping, screwing or snap-locking.

10. The writing instrument according to claim 1, wherein the deformable nose is overmolded on a section of the housing or assembled on a section of the housing by radial clamping, screwing or snap-locking.

11. The writing instrument according to claim 1, wherein the deformable nose has a Shore hardness greater than or equal to 60 Shore A, and less than or equal to 80 Shore A.

12. A writing instrument comprising a housing extending in a longitudinal direction and having a radial direction, the writing instrument comprising a first concentric writing tip and a second concentric writing tip, the second writing tip being arranged around the first writing tip, each writing tip being received in the housing and being able to assume an operating configuration in which the writing tip protrudes from the housing, the housing comprising, at a longitudinal end, a deformable nose at least in the radial direction, the deformable nose comprising at least one slit extending in the longitudinal direction, the deformable nose only being deformed when the second writing tip is in the operating configuration, wherein the deformable nose includes an exit opening of the first and second writing tips, a diameter of the exit opening being greater than a diameter of the first writing tip and less than a diameter of the second writing tip.

13. A writing instrument comprising a housing extending in a longitudinal direction and having a radial direction, the writing instrument comprising a first writing tip and a second writing tip, the second writing tip surrounding the first writing tip, the first writing tip being fixed to permanently protrude from the housing, and the second writing tip being moveable between an operating configuration in which the second writing tip protrudes from the housing, and a retracted configuration in which the second writing tip is within the housing, the housing comprising, at a longitudinal end, a deformable nose at least in the radial direction, the deformable nose comprising at least one slit extending in the longitudinal direction, the deformable nose only being deformed when the second writing tip is in an operating configuration, wherein the deformable nose includes an exit opening of the second writing tip, a diameter of the exit opening being greater than a diameter of the first writing tip and less than a diameter of the second writing tip.

* * * * *